US010366684B2

(12) United States Patent
Maezawa et al.

(10) Patent No.: US 10,366,684 B2
(45) Date of Patent: Jul. 30, 2019

(54) INFORMATION PROVIDING METHOD AND INFORMATION PROVIDING DEVICE

(71) Applicant: YAMAHA CORPORATION, Hamamatsu-shi (JP)

(72) Inventors: Akira Maezawa, Hamamatsu (JP); Takahiro Hara, Hamamatsu (JP); Yoshinari Nakamura, Musashino (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/598,351

(22) Filed: May 18, 2017

(65) Prior Publication Data

US 2017/0256246 A1 Sep. 7, 2017

Related U.S. Application Data

(63) Continuation of application No. PCT/JP2015/082514, filed on Nov. 19, 2015.

(30) Foreign Application Priority Data

Nov. 21, 2014 (JP) ..... 2014-236792

(51) Int. Cl.
*G10H 1/00* (2006.01)
*G10H 1/40* (2006.01)
(Continued)

(52) U.S. Cl.
CPC ..... *G10H 1/40* (2013.01); *G10G 1/00* (2013.01); *G10H 1/00* (2013.01); *G10H 1/0033* (2013.01);
(Continued)

(58) Field of Classification Search
CPC ..... G10H 1/40; G10H 1/36
(Continued)

(56) References Cited

U.S. PATENT DOCUMENTS 4,484,507 A * 11/1984 Nakada ..... G10H 1/26 84/470 R
5,315,911 A * 5/1994 Ochi ..... G09B 15/002 84/477 R
(Continued)

FOREIGN PATENT DOCUMENTS

EP 2919228 A1 9/2015
JP S57124396 A 8/1982
(Continued)

OTHER PUBLICATIONS

Notice of Allowance issued in U.S. Appl. No. 15/597,675 dated Mar. 9, 2018.
(Continued)

*Primary Examiner* — David S Warren
(74) *Attorney, Agent, or Firm* — Rossi, Kimms & McDowell LLP

(57) ABSTRACT

The information providing method includes: sequentially identifying a performance speed at which a user performs a piece of music; identifying, in the piece of music, a performance position that is performed by the user; setting an adjustment amount in accordance with a temporal variation in the identified performance speed; and providing the user with music information corresponding to a time point that is later, by the adjustment amount, than a time point that corresponds to the performance position identified in the piece of music.

17 Claims, 5 Drawing Sheets

(51) Int. Cl.
*G10G 1/00* (2006.01)
*G10H 1/36* (2006.01)

(52) U.S. Cl.
CPC ..... *G10H 1/36* (2013.01); *G10H 2210/076* (2013.01); *G10H 2210/391* (2013.01); *G10H 2240/175* (2013.01)

(58) Field of Classification Search
USPC ..... 84/609
See application file for complete search history.

(56) References Cited

U.S. PATENT DOCUMENTS 5,521,323 A * 5/1996 Paulson ..... G10H 1/361 84/453
5,693,903 A * 12/1997 Heidorn ..... G10H 1/361 84/609
5,894,100 A * 4/1999 Otsuka ..... G09B 15/04 84/477 R
5,913,259 A * 6/1999 Grubb ..... G10H 1/36 84/610
5,952,597 A * 9/1999 Weinstock ..... G10G 3/04 84/477 R
6,051,769 A * 4/2000 Brown, Jr. ..... G09B 15/023 84/470 R
6,107,559 A * 8/2000 Weinstock ..... G10G 3/04 84/470 R
6,156,964 A * 12/2000 Sahai ..... G09B 15/04 84/470 R
6,166,314 A * 12/2000 Weinstock ..... G10G 3/04 84/477 R
6,333,455 B1 * 12/2001 Yanase ..... G09B 15/00 84/470 R
6,376,758 B1 * 4/2002 Yamada ..... G10H 1/40 84/610
6,380,472 B1 * 4/2002 Sugiyama ..... G09B 15/08 84/470 R
6,380,474 B2 * 4/2002 Taruguchi ..... G10H 1/0008 84/477 R
7,164,076 B2 * 1/2007 McHale ..... G10H 1/368 434/307 A
7,189,912 B2 * 3/2007 Jung ..... G09B 15/00 84/477 R
7,297,856 B2 * 11/2007 Sitrick ..... G09B 15/002 84/470 R
7,482,529 B1 * 1/2009 Flamini ..... G10H 1/0008 84/609
7,579,541 B2 * 8/2009 Guldi ..... G09B 15/00 84/470 R
7,649,134 B2 * 1/2010 Kashioka ..... G10G 1/00 84/486
7,989,689 B2 * 8/2011 Sitrick ..... G09B 15/023 84/477 R
8,015,123 B2 * 9/2011 Barton ..... G06Q 30/02 705/500
8,180,063 B2 * 5/2012 Henderson ..... G10H 1/0066 381/61
8,338,684 B2 * 12/2012 Pillhofer ..... G09B 15/00 84/470 R
8,367,921 B2 * 2/2013 Evans ..... G09B 15/00 84/609
8,440,901 B2 * 5/2013 Nakadai ..... G09B 15/02 84/612
8,445,766 B2 * 5/2013 Raveendran ..... G10G 1/00 84/470 R
8,629,342 B2 * 1/2014 Lee ..... G09B 15/00 84/477 R
8,660,678 B1 * 2/2014 Lavi ..... G10H 1/0066 700/94
8,686,271 B2 * 4/2014 Wang ..... G06F 17/30861 84/600
8,785,757 B2 * 7/2014 Pillhofer ..... G09B 15/00 84/470 R
8,838,835 B2 9/2014 Hara
8,889,976 B2 * 11/2014 Nakadai ..... G10H 1/361 84/477 R
8,990,677 B2 * 3/2015 Sitrick ..... G06Q 10/101 715/201
8,996,380 B2 * 3/2015 Wang ..... G06F 17/30861 704/270
9,135,954 B2 * 9/2015 Sitrick ..... G09G 5/377
9,275,616 B2 * 3/2016 Uemura ..... G06K 9/00476
9,959,851 B1 * 5/2018 Fernandez ..... G10H 1/0066
2001/0023635 A1 9/2001 Taruguchi et al.
2002/0078820 A1 * 6/2002 Miyake ..... G10H 1/0091 84/662
2002/0118562 A1 8/2002 Hiratsuka
2004/0025676 A1 * 2/2004 Shadd ..... G10H 3/146 84/743
2004/0177744 A1 * 9/2004 Strasser ..... G09B 19/00 84/470 R
2005/0115382 A1 * 6/2005 Jung ..... G09B 15/00 84/616
2008/0196575 A1 * 8/2008 Good ..... G09B 15/04 84/470 R
2008/0282872 A1 * 11/2008 Ma ..... G10H 1/0575 84/627
2009/0229449 A1 * 9/2009 Yamada ..... G10H 1/348 84/612
2011/0003638 A1 1/2011 Lee et al.
2011/0277615 A1 * 11/2011 Kendler ..... G10G 1/00 84/483.2
2015/0206441 A1 7/2015 Brown
2017/0018262 A1 * 1/2017 Pinuela Irrisarri ..... G10G 1/00
2017/0220855 A1 8/2017 Bose et al.
2017/0230651 A1 8/2017 Bose et al.
2017/0256246 A1 * 9/2017 Maezawa ..... G10G 1/00
2017/0294134 A1 10/2017 Angel et al.
2017/0337910 A1 11/2017 Maezawa et al.

FOREIGN PATENT DOCUMENTS

JP H03253898 A 11/1991
JP 2007279490 A 10/2007
JP 2011242560 A 12/2011
JP 2015079183 A 4/2015
WO 9916048 A1 4/1999
WO 2005022509 A1 3/2005

OTHER PUBLICATIONS

Extended European Search Report issued in European Application No. 15861046.9 dated Apr. 10, 2018.
International Search Report issued in Intl. Appln. No. PCT/JP2015/082514 dated Feb. 2, 2016. English translation provided.
Written Opinion issued in Intl. Appln. No. PCT/JP2015/082514 dated Feb. 2, 2016. English translation provided.
International Preliminary Report on Patentability issued in Intl. Appln. No. PCT/JP2015/082514 dated May 23, 2017. English translation provided.
Maezawa et al. "Non-Score-Based Music Parts Mixture Audio Alignment." Information Processing Society of Japan. SIG Technical Report. Sep. 1, 2013: 1-6. vol. 2013-MUS-100, No. 14. Cited in Specification. English abstract provided.
Maezawa et al. "Inter-Acoustic-Signal Alignment Based on Latent Common Structure Model." Information Processing Society of Japan. SIG Technical Report. May 24, 2014: 1-6. vol. 2014-MUS-103, No. 23. Cited in Specification. English abstract provided.
Shirogane et al. "Description and Verification of an Automatic Accompaniment System by a Virtual Text with Rendezvous." Information Processing Society of Japan. Mar. 15, 1995: 1-369-1-370. Cited in NPL 1, NPL 2, and NPL 3. English translation of NPL 1, NPL 2, and NPL 3 provided.
Inoue et al. "Adaptive Automated Accompaniment System for Human Singing." Transactions of Information Processing Society of Japan. Jan. 15, 1996: 31-38. vol. 37, No. 1. English abstract

(56) References Cited

OTHER PUBLICATIONS provided. Cited in NPL 1, NPL 2, and NPL 3. English translation of NPL 1, NPL 2, and NPL 3 provided.
Notice of Allowance issued in U.S. Appl. No. 15/597,675 dated Jul. 18, 2018.
Office Action issued in U.S. Appl. No. 15/597,675 dated Oct. 20, 2017.
Notice of Allowance issued in U.S. Appl. No. 15/597,675 dated Oct. 30, 2018.

* cited by examiner

INFORMATION PROVIDING METHOD AND INFORMATION PROVIDING DEVICE

TECHNICAL FIELD

The present invention relates to a technique of providing information that is synchronized with user's performance of a piece of music.

BACKGROUND ART

Conventionally, there have been proposed techniques (referred to as "score alignment") for performing analysis on a position in a piece of music at which position a user is currently performing the piece of music. Non-Patent Documents 1 and 2, for example, each disclose a technique for analyzing temporal correspondence between positions in a piece of music and sound signals representing performance sounds of the piece of music, by use of a probability model, such as a hidden Markov model (HMM).

RELATED ART DOCUMENT

Non-Patent Document 1: MAEZAWA, Akira, OKUNO, Hiroshi G. "Non-Score-Based Music Parts Mixture Audio Alignment", IPSJ SIG Technical Report, Vol. 2013-MUS-100 No. 14, 2013 Sep. 1

Non-Patent Document 2: MAEZAWA, Akira, ITOYAMA, Katsutoshi, YOSHII, Kazuyoshi, OKUNO, Hiroshi G. "Inter-Acoustic-Signal Alignment Based on Latent Common Structure Model", IPSJ SIG Technical Report, Vol. 2014-MUS-103 No. 23, 2014 May 24

It would be convenient for producing multiple music part performance sounds if, while analyzing a position in a piece of music being performed by a user, an accompaniment instrumental and/or vocal sound can be reproduced synchronously with the performance of the user based on the music information that has been prepared in advance. Performing analysis, etc., on a performance position, however, involves a processing delay. Therefore, if a user is provided with music information that corresponds to a time point corresponding to a performance position in a piece of music, which position is identified based on a performance sound, the music information provided becomes delayed with respect to the user's performance. Described above is a processing delay that is involved in analysis of a performance position, and a delay may also occur in providing music information due to a communication delay among devices in a communication system because in such a communication system a performance sound that has been transmitted from a terminal device is received via a communication network and analyzed, and music information is then transmitted to the terminal device.

SUMMARY OF THE INVENTION

In consideration of the circumstances described above, it is an object of the present invention to reduce a delay that is involved in providing music information.

In order to solve the aforementioned problem, an information providing method according to a first aspect of the present invention includes: sequentially identifying a performance speed at which a user performs a piece of music; identifying, in the piece of music, a performance position at which the user is performing the piece of music; setting an adjustment amount in accordance with a temporal variation in the identified performance speed; and providing the user with music information corresponding to a time point that is later, by the set adjustment amount, than a time point that corresponds to the performance position identified in the piece of music. In this configuration, a user is provided with music information that corresponds to a time point that is later, by the adjustment amount, than the time point that corresponds to a position that is being performed by the user in the piece of music.

An information providing method according to a second aspect of the present invention includes: sequentially identifying a performance speed of performance of a user; identifying a beat point of the performance of the user; setting an adjustment amount in accordance with a temporal variation in the identified performance speed; and indicating, to the user, a beat point at a time point that is shifted with respect to the identified beat point by the set adjustment amount.

MODES FOR CARRYING OUT THE INVENTION

First Embodiment

Figure 1:
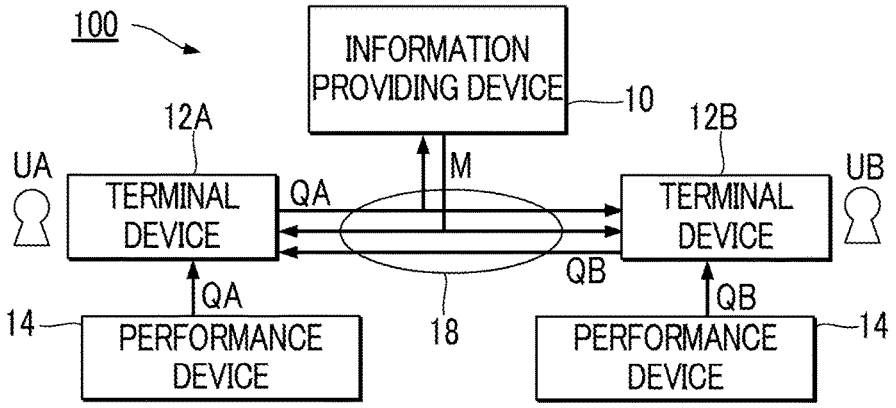
FIG. 1 is a block diagram of a communication system according to a first embodiment of the present invention.

FIG. 1 is a block diagram of a communication system 100 according to a first embodiment. The communication system 100 according to the first embodiment includes an information providing device 10 and a plurality of terminal devices 12 (12A and 12B). Each terminal device 12 is a communication terminal that communicates with the information providing device 10 or another terminal device 12 via a communication network 18, such as a mobile communication network and the Internet. A portable information processing device, such as a portable telephone and a smart phone, or a portable or stationary information processing device, such as a personal computer, can be used as the terminal device 12, for example.

A performance device 14 is connected to each of the terminal devices 12. Each performance device 14 is an input device, which receives performance of a specific piece of music by each user U (UA or UB) of the corresponding terminal device 12, and generates performance information Q (QA or QB) representing a performance sound of the piece of music. An electrical musical instrument that generates a sound signal representing a time waveform of the performance sound as the performance information Q, or one that generates as the performance information Q time series data representing content of the performance sound (e.g., a MIDI instrument that outputs MIDI-format data in time series), for example, can be used as the performance device 14. Furthermore, an input device included in the terminal device 12 can also be used as the performance device 14. In the following example a case is assumed where the user UA of the terminal device 12A performs a first part of a piece of music and the user UB of the terminal device 12B performs a second part of the piece of music. It is of note, however, that the respective contents of the first and second parts of the piece of music may be identical or differ from each other.

Figure 2:
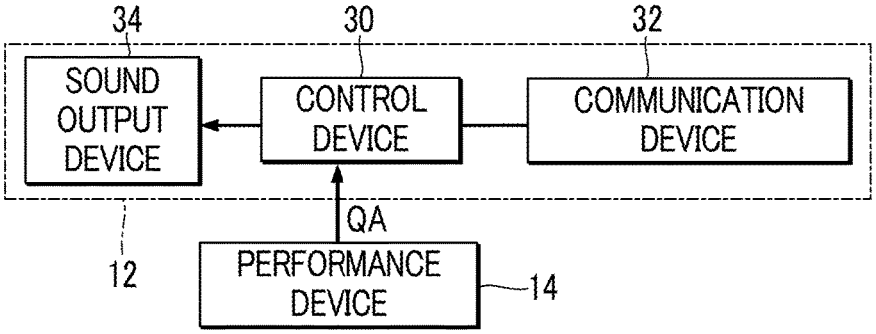
FIG. 2 is a block diagram of a terminal device.

FIG. 2 is a block-diagram of the terminal device 12 (12A or 12B). As illustrated in FIG. 2, the terminal device 12 includes a control device 30, a communication device 32, and a sound output device 34. The control device 30 integrally controls the elements of the terminal device 12. The communication device 32 communicates with the information providing device 10 or another terminal device 12 via the communication network 18. The sound output device 34 (e.g., a loudspeaker or headphones) outputs a sound instructed by the control device 30.

The user UA of the terminal device 12A and the user UB of the terminal device 12B are able to perform music together in ensemble via the communication network 18 (a so-called "network session"). Specifically, as illustrated in FIG. 1, the performance information QA corresponding to the performance of the first part by the user UA of the terminal device 12A, and the performance information QB corresponding to the performance of the second part by the user UB of the terminal device 12B, are transmitted and received mutually between the terminal devices 12A and 12B via the communication network 18.

Meanwhile, the information providing device 10 as in the first embodiment sequentially provides each of the terminal devices 12A and 12B with sampling data (discrete data) of music information M synchronously with the performance of the user UA of the terminal device 12A, the music information M representing a time waveform of an accompaniment sound of the piece of music (a performance sound of an accompaniment part that differs from the first part and the second part). As a result of the operation described above, a sound mixture consisting of a performance sound of the first part, a performance sound of the second part, and the accompaniment sound is output from the respective sound output devices 34 of the terminal devices 12A and 12B, with the performance sound of the first part being represented by the performance information QA, the performance sound of the second part by the performance information QB, and the accompaniment sound by the music information M. Each of the users UA and UB are thus enabled to perform the piece of music by operating the performance device 14 while listening to the accompaniment sound provided by the information providing device 10 and to the performance sound of the counterpart user.

Figure 3:
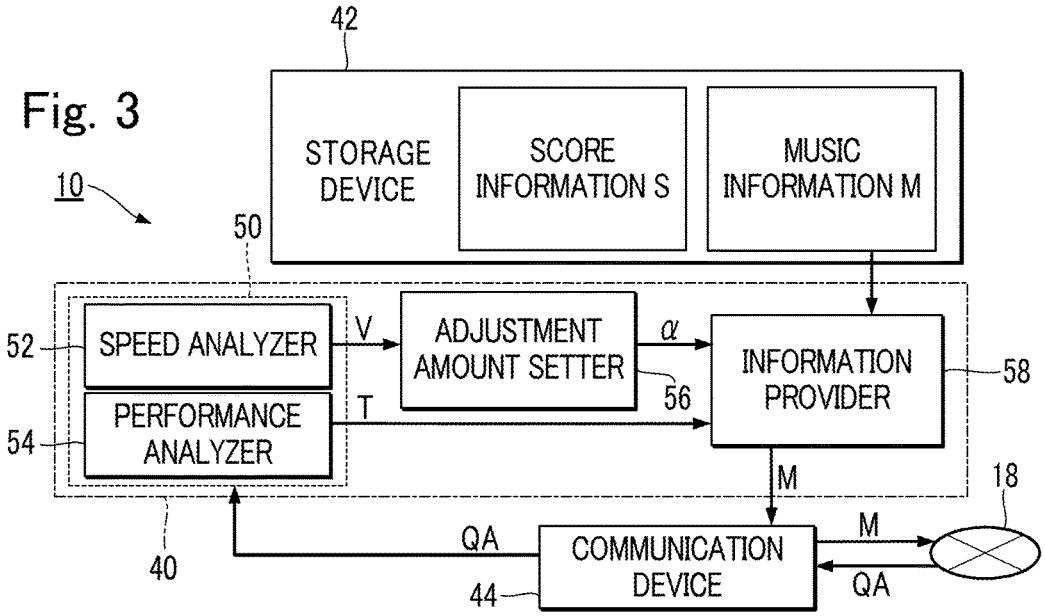
FIG. 3 is a block diagram of an information providing device.

FIG. 3 is a block diagram of the information providing device 10. As illustrated in FIG. 3, the information providing device 10 according to the first embodiment includes a control device 40, a storage device 42, and a communication device (communication means) 44. The storage device 42 stores a program to be executed by the control device 40 and various data used by the control device 40. Specifically, the storage device 42 stores the music information M representing the time waveform of the accompaniment sound of the piece of music, and also stores score information S representing a score (a time series consisting of a plurality of notes) of the piece of music. The storage device 42 is a non-transitory recording medium, a preferable example of which is an optical storage medium, such as a CD-ROM (optical disc). The storage device 42 may include a freely selected form of publically known storage media, such as a semiconductor storage medium and a magnetic storage medium.

The communication device 44 communicates with each of the terminal devices 12 via the communication network 18. Specifically, the communication device 44 as in the first embodiment receives, from the terminal device 12A, the performance information QA of the performance of the user UA. In the meantime, the communication device 44 sequentially transmits the sampling data of the music information M to each of the terminal devices 12A and 12B, such that the accompaniment sound is synchronized with the performance represented by the performance information QA.

By executing the program stored in the storage device 42, the control device 40 realizes multiple functions (an analysis processor 50, an adjustment amount setter 56, and an information provider 58) for providing the music information M to the terminal devices 12. It is of note, however, that a configuration in which the functions of the control device 40 are dividedly allocated to a plurality of devices, or a configuration which employs electronic circuitry dedicated to realize part of the functions of the control device 40, may also be employed.

The analysis processor 50 is an element that analyzes performance information QA received by the communication device 44 from the terminal device 12A, and includes a speed analyzer 52 and a performance analyzer 54. The speed analyzer 52 identifies a speed V of the performance (hereinafter referred to as a "performance speed") of the piece of music by the user UA. The performance of the user UA is represented by the performance information QA. The performance speed V is identified sequentially and in real time, in parallel with the progress of the performance of the piece of music by the user UA. The performance speed V is identified, for example, in the form of tempo which is expressed as the number of beats per unit time. A freely selected one of publically known techniques can be employed for the speed analyzer 52 to identify the performance speed V.

The performance analyzer 54 identifies, in the piece of music, a position T at which the user UA is performing the piece of music (this position will hereinafter be referred to as a "performance position"). Specifically, the performance analyzer 54 identifies the performance position T by collating the user UA's performance represented by the performance information QA with the time series of a plurality of notes indicated in the score information S that is stored in the storage device 42. The performance position T is identified sequentially and in real time, in parallel with the progress of the performance of the piece of music by the user UA. One of well-known techniques (e.g., the score alignment techniques disclosed in Non-Patent Documents 1 and 2) may be freely selected for employment for the performance analyzer 54 to identify the performance position T. It is of note that, in a case where the users UA and UB perform parts of the piece of music that are different from each other, the performance analyzer 54 first identifies the part performed by the user UA, among a plurality of parts indicated in the score information S, and then identifies the performance position T.

The information provider 58 in FIG. 3 provides each of the users UA and UB with the music information M, which represents the accompaniment sound of the piece of music.

Specifically, the information provider 58 transmits sequentially and in real time the sampling data of the music information M of the piece of music from the communication device 44 to each of the terminal devices 12A and 12B.

Figure 4:
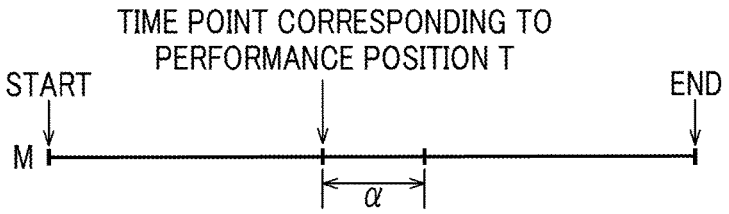
FIG. 4 is a diagram for explaining a relation between an adjustment amount $\alpha$ and a time point that corresponds to a performance position.

A delay (a processing delay and a communication delay) may occur from a time point at which the user UA performs the piece of music until the music information M is received and played by the terminal device 12A or 12B, because the music information M is transmitted from the information providing device 10 to the terminal device 12A or 12B after the performance information QA is transmitted from the terminal device to the information providing device 10 and is analyzed at the information providing device 10. As illustrated in FIG. 4, the information provider 58 as in the first embodiment sequentially transmits, to the terminal device 12A or 12B through the communication device 44, sampling data of a portion that corresponds to a later (future) time point, by an adjustment amount α, than a time point (position on a time axis corresponding to the music information M) that corresponds to the performance position T identified by the performance analyzer 54 in the music information M of the piece of music. In this way, the accompaniment sound represented by the music information M becomes substantially coincident with the performance sound of the user UA or that of the user UB (i.e., the accompaniment sound and the performance sound of a specific portion in the piece of music are played in parallel) despite occurrence of a delay. The adjustment amount setter 56 in FIG. 3 sets the adjustment amount (anticipated amount) a to be variable, and this adjustment amount α is utilized by the information provider 58 when providing the music information M.

Figure 7A:
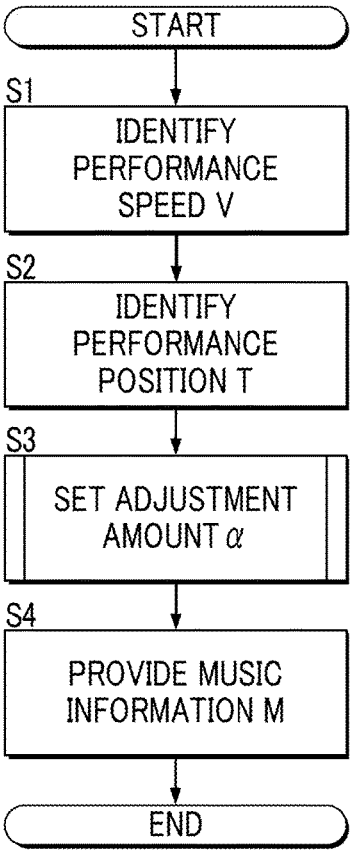
FIG. 7A is a flowchart showing an operation performed by a control device.

FIG. 7A is a flowchart showing an operation performed by the control device 40. As described above, the speed analyzer 52 identifies a performance speed V at which the user U performs the piece of music (S1). The performance analyzer 54 identifies, in the piece of music, a performance position T at which the user U is currently performing the piece of music (S2). The adjustment amount setter 56 sets an adjustment amount α (S3). Details of an operation of the adjustment amount setter 56 for setting the adjustment amount α will be described later. The information provider 58 provides the user (the user U or the terminal device 12) with sampling data that corresponds to a later (future) time point, by the adjustment amount α, than a time point that corresponds to the performance position T in the music information M of the piece of music, the position T being identified by the performance analyzer 54 (S4). As a result of this series of operations being repeated, the sampling data of the music information M is sequentially provided to the user U.

A delay (a processing delay and a communication delay) of approximately 30 ms may occur from a time point at which the user UB performs a specific portion of the piece of music until the performance sound of the performance of that specific portion is output from the sound output device 34 of the terminal device 12A, because, after the user UB performs that portion, the performance information QB is transmitted by the terminal device 12B and received by the terminal device 12A before the performance sound is played at the terminal device 12A. The user UA performs his/her own part as follows so that the performance of the user UA and the performance of the user UB become coincident with each other despite occurrence of a delay as illustrated above. With the performance device 14, the user UA performs his/her own part corresponding to a specific portion performed by the user UB in the piece of music, at a (first) time point that temporally precedes (is earlier than) a (second) time point at which the performance sound corresponding to that specific portion is expected to be output from the sound output device 34 of the terminal device 12A. Here, the first time point is earlier than the second time point by a delay amount estimated by the user UA (this delay estimated by the user UA will hereinafter be referred to as a "recognized delay amount"). That is to say, the user UA plays the performance device 14 by temporally preceding, by his/her own recognized delay amount, the performance sound of the user UB that is actually output from the sound output device 34 of the terminal device 12A.

The recognized delay amount is a delay amount that the user UA estimates as a result of listening to the performance sound of the user UB. The user UA estimates the recognized delay amount in the course of performing the piece of music, on an as-needed basis. Meanwhile, the control device 30 of the terminal device 12A causes the sound output device 34 to output the performance sound of the performance of the user UA at a time point that is delayed with respect to the performance of the user UA by a prescribed delay amount (e.g., a delay amount of 30 ms estimated either experimentally or statistically). As a result of the aforementioned process being executed in each of the terminal devices 12A and 12B, each terminal device 12A and 12B outputs a sound in which the performance sounds of the users UA and UB are substantially coincident with each other.

The adjustment amount α set by the adjustment amount setter 56 is preferably set to a time length that corresponds to the recognized delay amounts perceived by the respective users U. However, since the delay amounts are predicted by the respective users U, the recognized delay amount cannot be directly measured. Accordingly, with the results of simulation explained in the following taken into consideration, the adjustment amount setter 56 according to the first embodiment sets the adjustment amount α to be variable in accordance with a temporal variation in the performance speed V identified by the speed analyzer 52.

Figure 5:
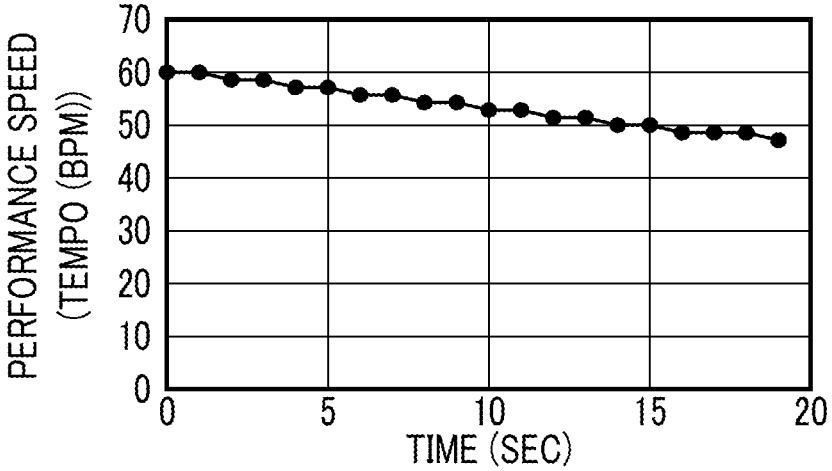
FIG. 5 is a graph showing a variation in performance speed over time in a case where an adjustment amount is smaller than a recognized delay amount.
Figure 6:
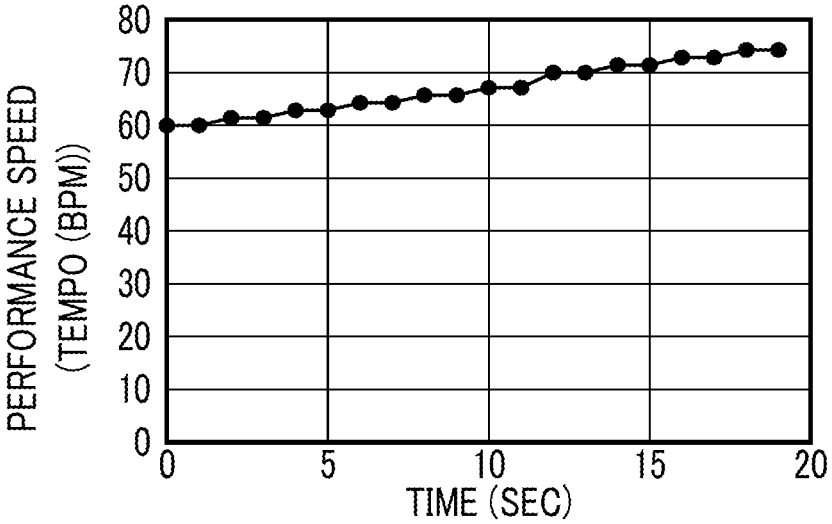
FIG. 6 is a graph showing a variation in performance speed over time in a case where an adjustment amount is greater than a recognized delay amount.

FIGS. 5 and 6 each show a result of simulating a temporal variation in a performance speed in a case where a performer performs a piece of music while listening to an accompaniment sound of the piece of music that is played in accordance with a prescribed adjustment amount α. FIG. 5 shows a result obtained in a case where the adjustment amount α is set to a time length that is shorter than a time length corresponding to the recognized delay amount perceived by a performer, whereas FIG. 6 shows a result obtained in a case where the adjustment amount α is set to a time length that is longer than the time length corresponding to the recognized delay amount. Where the adjustment amount α is smaller than the recognized delay amount, the accompaniment sound is played so as to be delayed relative to a beat point predicted by the user. Therefore, as understood from FIG. 5, in a case where the adjustment amount α is smaller than the recognized delay amount, a tendency is observed for the performance speed to decrease over time (the performance to gradually decelerate). On the other hand, in a case where the adjustment amount α is greater than the recognized delay amount, the accompaniment sound is played so as to precede the beat point predicted by the user. Therefore, as understood from FIG. 6, in a case where the adjustment amount α is greater than the recognized delay amount, a tendency is observed for the performance speed to increase over time (the performance to gradually accelerate). Considering these tendencies, the adjustment amount α can be evaluated as being smaller than the recognized delay amount when a decrease in the performance speed over time is observed, and can be evaluated as being greater than the recognized delay amount when an increase in the performance speed over time is observed.

In accordance with the foregoing, the adjustment amount setter 56 as in the first embodiment sets the adjustment amount α to be variable in accordance with a temporal variation in the performance speed V identified by the speed analyzer 52. Specifically, the adjustment amount setter 56 sets the adjustment amount α in accordance with a temporal variation in the performance speed V, such that the adjustment amount α decreases when the performance speed V increases over time (i.e., when the adjustment amount α is estimated to be greater than the recognized delay amount perceived by the user UA), and such that the adjustment amount α increases when the performance speed V decreases over time (i.e., when the adjustment amount α is estimated to be smaller than the recognized delay amount perceived by the user UA). Accordingly, in a situation where the performance speed V increases over time, a variation in the performance speed V is turned into a decrease by allowing the respective beat points of the accompaniment sound represented by the music information M to move behind a time series of respective beat points predicted by the user UA, whereas in a situation where the performance speed V decreases over time, a variation in the performance speed V is turned into an increase by allowing the respective beat points of the accompaniment sound to move ahead of a time series of respective beat points predicted by the user UA. In other words, the adjustment amount α is set such that the performance speed V of the user UA be maintained essentially constant.

Figure 7B:
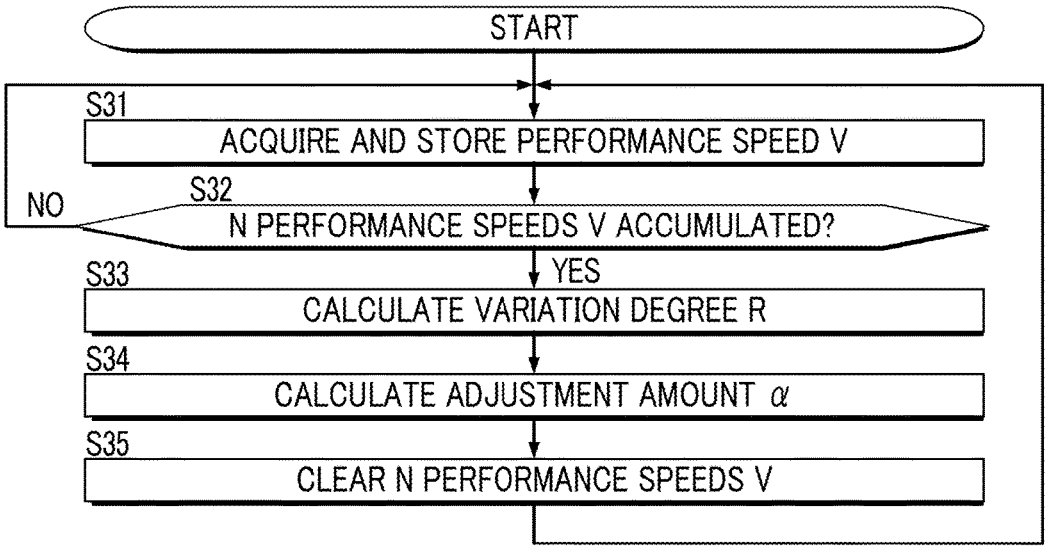
FIG. 7B is a flowchart showing an operation of an adjustment amount setter.

FIG. 7B is a flowchart showing an operation of the adjustment amount setter 56 for setting the adjustment amount α. The adjustment amount setter 56 acquires the performance speed V identified by the speed analyzer 52 and stores the same in the storage device 42 (buffer) (S31). Having repeated the acquisition and storage of the performance speed V so that N number of the performance speeds V are accumulated in the storage device 42 (S32: YES), the adjustment amount setter 56 calculates a variation degree R among the performance speeds V from the time series consisting of the N number of the performance speeds V stored in the storage device 42 (S33). The variation degree R is an indicator of a degree and a direction (either an increase or a decrease) of the temporal variation in the performance speed V. Specifically, the variation degree R may preferably be an average of gradients of the performance speeds V, each of the gradients being determined between two consecutive performance speeds V; or a gradient of a regression line of the performance speeds V obtained by linear regression.

The adjustment amount setter 56 sets the adjustment amount α to be variable in accordance with the variation degree R among the performance speeds V (S34). Specifically, the adjustment amount setter 56 according to the first embodiment calculates a subsequent adjustment amount α ($\alpha_{t+1}$) through an arithmetic expression $F(\alpha_t,R)$ in Expression (1), where a current adjustment amount α ($\alpha_t$) and the variation degree R among the performance speeds V are variables of the expression.

$$\alpha_{t+1}=F(\alpha_t,R)=\alpha_t \exp(cR) \quad (1)$$

Figure 8:
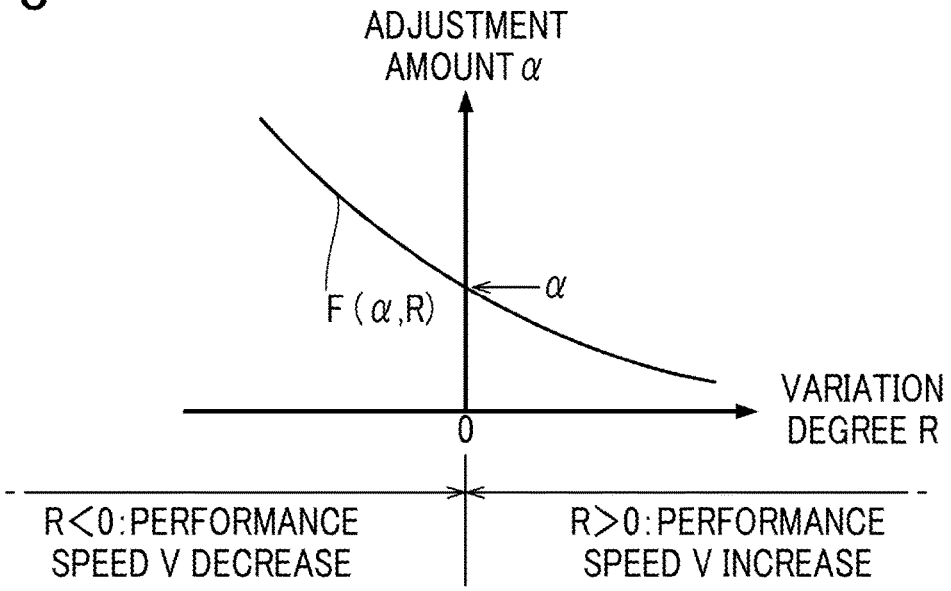
FIG. 8 is a graph showing a relation between variation degree among performance speeds and adjustment amount.

The symbol "c" in Expression (1) is a prescribed negative number (c<0). FIG. 8 is a graph showing a relation between the variation degree R and the adjustment amount α. As will be understood from Expression (1) and FIG. 8, the adjustment amount α decreases as the variation degree R increases while the variation degree R is in the positive range (i.e., when the performance speed V increases), and the adjustment amount α increases as the variation degree R decreases while the variation degree R is in the negative range (i.e., when the performance speed V decreases). The adjustment amount α is maintained constant when the variation degree R is 0 (i.e., when the performance speed V is maintained constant). An initial value of the adjustment amount α is set, for example, to a prescribed value selected in advance.

Having calculated the adjustment amount α by the above procedure, the adjustment amount setter 56 clears the N number of the performance speeds V stored in the storage device 42 (S35), and the process then returns to step S31. As will be understood from the explanation given above, calculation of the variation degree R (S33) and update of the adjustment amount α (S34) are performed repeatedly for every set of N number of the performance speeds V identified from the performance information QA by the speed analyzer 52.

In the first embodiment, as explained above, at each terminal device 12, an accompaniment sound is played which corresponds to a portion of the music information M, and this portion corresponds to a time point that is later, by the adjustment amount α, than a time point corresponding to the performance position T of the user UA. Thus, a delay in providing the music information M can be reduced in comparison to a configuration of providing the respective terminal devices 12 with a portion of the music information M that corresponds to a time point corresponding to the performance position T. In the first embodiment, a delay might occur in providing the music information M due to a communication delay because information (e.g., the performance information QA and the music information M) is transmitted and received via the communication network 18. Therefore, an effect of the present invention, i.e., reducing a delay in providing music information M, is particularly pronounced. Moreover, in the first embodiment, since the adjustment amount α is set to be variable in accordance with a temporal variation (the variation degree R) in the performance speed V of the user UA, it is possible to guide the performance of the user UA such that the performance speed V is maintained essentially constant. Frequent fluctuations in the adjustment amount α can also be reduced in comparison to a configuration in which the adjustment amount α is set for each performance speed V.

In a case where multiple terminal devices 12 perform music in ensemble over the communication network 18, it is also possible to adopt a configuration in which performance information Q (e.g., QA) of the user U himself/herself of a prescribed amount is buffered in a corresponding terminal device 12 (e.g., 12A), and a read position of the buffered performance information Q (e.g., QA) is controlled so as to be variable in accordance with the communication delay involved in the actual delay in providing music information M and performance information Q (e.g., QB) of another user U, for the purpose of compensating for fluctuations in a communication delay occurring in the communication network 18. When the first embodiment is applied to this configuration, since the adjustment amount α is controlled so as to be variable in accordance with a temporal variation in the performance speed V, an advantage is obtained in that the amount of delay in buffering the performance information Q can be reduced.

Second Embodiment

The second embodiment of the present invention will now be explained. In the embodiments illustrated in the following, elements that have substantially the same effects and/or functions as those of the elements in the first embodiment will be assigned the same reference signs as in the description of the first embodiment, and detailed description thereof will be omitted as appropriate.

The first embodiment illustrates a configuration in which the speed analyzer 52 identifies the performance speeds V across all sections of the piece of music. The speed analyzer 52 according to the second embodiment identifies the performance speed V of the user UA sequentially for a specific section (hereinafter referred to as an "analyzed section") in the piece of music.

The analyzed section is a section in which the performance speed V is highly likely to be maintained essentially constant, and such a section(s) is (are) identified by referring to the score information S stored in the storage device 42. Specifically, the adjustment amount setter 56 identifies, as the analyzed section, a section other than a section on which an instruction is given to increase or decrease a performance speed (i.e., a section on which an instruction is given to maintain the performance speed V) in the score of the piece of music as indicated in the score information S. For each of analyzed section(s) of the piece of music, the adjustment amount setter 56 calculates a variation degree R among performance speeds V. In the piece of music, the performance speeds V are not identified for sections other than the analyzed sections, thus the performance speeds V in those sections other than the analyzed sections are not reflected in the variation degree R (nor in the adjustment amount α).

Substantially the same effects as those of the first embodiment are obtained in the second embodiment. In the second embodiment, since the performance speeds V of the user U are identified for specific sections of the piece of music, a processing load in identifying the performance speeds V is reduced in comparison to a configuration in which the performance speeds V are identified for all sections. Moreover, the analyzed section is identified based on the score information S, i.e., the score information S used to identify the performance position T is also used to identify the analyzed section. Therefore, an amount of data retained in the storage device 42 (hence a storage capacity needed for the storage device 42) is reduced in comparison to a configuration in which information indicating performance speeds of the score of the piece of music and score information S used to identify a performance position T are retained as separate information. In the second embodiment, moreover, since the adjustment amount α is set in accordance with the performance speeds V in the analyzed section(s) of the piece of music, an advantage is obtained in that it is possible to set an appropriate adjustment amount α that is free of the impact of fluctuations in the performance speed V, which fluctuations occur as a result of musical expressivity in performance of the user UA.

In the example described above, the performance speed V is calculated by selecting, as a section to be analyzed, a section in the piece of music in which section the performance speed V is highly likely to be maintained essentially constant. However, a method of selecting an analyzed section is not limited to the above example. For example, by referring to the score information S, the adjustment amount setter 56 may select as the analyzed section a section in the piece of music on which it is easy to identify a performance speed V with good precision. For example, in the piece of music, it tends to be easier to identify a performance speed V with high accuracy in a section in which a large number of short notes are distributed, as opposed to a section in which long notes are distributed. Accordingly, the adjustment amount setter 56 may be preferably configured to identify as the analyzed section a section in the piece of music, in which section there are a large number of short notes, such that performance speeds V are identified for the identified analyzed section. Specifically, in a case where the total number of notes (i.e., appearance frequency of notes) in a section having a prescribed length (e.g., a prescribed number of bars) is equal to or greater than a threshold, the adjustment amount setter 56 may identify that section as the analyzed section. The speed analyzer 52 identifies performance speeds V for that section, and the adjustment amount setter 56 calculates a variation degree R among the performance speeds V in that section. Therefore, the performance speeds V of the performance in a section(s) each having the prescribed length and including the number of notes equal to or greater than the threshold are reflected in the adjustment amount α. Meanwhile, the performance speeds V of the performance in a section(s) each having the prescribed length and including the number of notes smaller than the threshold are not identified, and the performance speeds V of the performance of the section(s) are not reflected in the adjustment amount α.

Substantially the same effects as those of the first embodiment are also obtained in the above configuration. Moreover, as described above, a processing load in identifying the performance speeds V is reduced in comparison to a configuration in which the performance speeds V are identified for all sections. Substantially the same effect as the aforementioned effect achieved by utilizing the score information S to identify the analyzed section can also be obtained. Furthermore, since a section on which it is relatively easy to identify a performance speed with good precision is identified as the analyzed section, an advantage is obtained in that it is possible to set an appropriate adjustment amount α that is based on performance speeds identified with high accuracy.

Third Embodiment

As described with reference to FIGS. 5 and 6, there is a tendency for the performance speed to decrease over time when the adjustment amount α is smaller than the recognized delay amount, and to increase over time when the adjustment amount α is greater than the recognized delay amount. With this tendency taken into consideration, the information providing device 10 as in the third embodiment indicates a beat point to the user UA at a time point corresponding to the adjustment amount α, thereby guiding the user UA such that the performance speed of the user UA be maintained essentially constant.

The performance analyzer 54 as in the third embodiment sequentially identifies a beat point of the performance (hereinafter referred to as a "performance beat point") of the user UA, by analyzing the performance information QA received by the communication device 44 from the terminal device 12A. One of well-known techniques can be freely selected for employment for the performance analyzer 54 to identify the performance beat points. Meanwhile, the adjustment amount setter 56 sets the adjustment amount α to be variable in accordance with a temporal variation in the performance speed V identified by the speed analyzer 52, similarly to the first embodiment. Specifically, the adjustment amount setter 56 sets the adjustment amount α in accordance with a variation degree R among the performance speeds V, such that the adjustment amount α decreases when the performance speed V increases over time (R>0), and that the adjustment amount α increases when the performance speed V decreases over time (R<0).

The information provider 58 as in the third embodiment sequentially indicates a beat point to the user UA at a time point that is shifted, by the adjustment amount α, from the performance beat point identified by the performance analyzer 54. Specifically, the information provider 58 sequentially transmits, from the communication device 44 to the terminal device 12A of the user UA, a sound signal representing a sound effect (e.g., a metronome click) for enabling the user UA to perceive a beat point. Specifically, a timing at which the information providing device 10 transmits a sound signal representing a sound effect to the terminal device 12A is controlled in the following manner. That is, in a case where the performance speed V decreases over time, the sound output device 34 of the terminal device 12A outputs a sound effect at a time point preceding a performance beat point of the user UA, and in a case where the performance speed V increases over time, the sound output device 34 of the terminal device 12A outputs a sound effect at a time point that is delayed with respect to a performance beat point of the user UA.

A method of allowing the user UA to perceive beat points is not limited to outputting of sounds. A blinker or a vibrator may be used to indicate beat points to the user UA. The blinker or the vibrator may be incorporated inside the terminal device 12, or attached thereto externally.

According to the third embodiment, a beat point is indicated to the user UA at a time point that is shifted, by the adjustment amount α, from a performance beat point identified by the performance analyzer 54 from the performance of the user UA, and thus an advantage is obtained in that the user UA can be guided such that the performance speed is maintained essentially constant.

Modifications

The embodiments illustrated above can be modified in various ways.

Specific modes of modification will be described in the following. Two or more modes selected from the following examples may be combined, as appropriate, in so far as the modes combined do not contradict one another.

(1) In the first and second embodiments described above, each terminal device 12 is provided with music information M that represents the time waveform of an accompaniment sound of a piece of music, but the content of the music information M is not limited to the above example. For example, music information M representing a time waveform of a singing sound (e.g., a voice recorded in advance or a voice generated using voice synthesis) of the piece of music can be provided to the terminal devices 12 from the information providing device 10. The music information M is not limited to information indicating a time waveform of a sound. For example, the music information M may be provided to the terminal devices 12 in the form of time series data in which operation instructions, to be directed to various types of equipment such as lighting equipment, are arranged so as to correspond to respective positions in the piece of music. Alternatively the music information M may be provided in the form of a moving image (or a time series consisting of a plurality of still images) related to the piece of music.

Furthermore, in a configuration in which a pointer indicating a performance position is arranged in a score image displayed on the terminal device 12, and in which the pointer is moved in parallel with the progress of the performance of the piece of music, the music information M is provided to the terminal device 12 in the form of information indicating a position of the pointer. It is of note that a method of indicating the performance position to the user is not limited to the above example (displaying of a pointer). For example, blinking by a light emitter, vibration of a vibrator, etc., can also be used to indicate the performance position (e.g., a beat point of the piece of music) to the user.

As will be understood from the above example, typical examples of the music information M include data of a time series that is supposed to progress temporally along with the progress of the performance or playback of the piece of music. The information provider 58 is comprehensively expressed as an element that provides music information M (e.g., a sound, an image, or an operation instruction) that corresponds to a time point that is later, by an adjustment amount α, than a time point (a time point on a time axis of the music information M) that corresponds to a performance position T.

(2) The format and/or content of the score information S may be freely selected. Any information representing performance contents of at least a part of the piece of music (e.g., lyrics, or scores consisting of tablature, chords, or percussion notation) may be used as the score information S.

(3) In each of the embodiments described above, an example was given of a configuration in which the information providing device 10 communicates with the terminal device 12A via the communication network 18, but the terminal device 12A may be configured to function as the information providing device 10. In this case, the control device 30 of the terminal device 12A functions as a speed analyzer, a performance analyzer, an adjustment amount setter, and an information provider. The information provider, for example, provides to the sound output device 34 sampling data of a portion corresponding to a time point that is later, by an adjustment amount α, than a time point corresponding to a performance position T identified by the performance analyzer in the music information M of the piece of music, thereby causing the sound output device 34 to output an accompaniment sound of the piece of music. As will be understood from the above explanation, the following operations are comprehensively expressed as operations to provide a user with music information M: an operation of transmitting music information M to a terminal device 12 from an information providing device 10 that is provided separately from the terminal devices 12, as described in the first and second embodiments; and an operation, performed by a terminal device 12A, of playing an accompaniment sound corresponding to the music information M in a configuration in which the terminal device 12A functions as an information providing device 10. That is to say, providing the music information M to a terminal device 12, and indicating the music information M to the user (e.g., emitting an accompaniment sound, or displaying a pointer indicating a performance position), are both included in the concept of providing music information M to the user.

Transmitting and receiving of performance information Q between the terminal devices 12A and 12B may be omitted (i.e., the terminal device 12B may be omitted). Alternatively, the performance information Q may be transmitted and received among three or more terminal devices 12 (i.e., ensemble performance by three or more users U).

In a scene where the terminal device 12B is omitted and in which only the user UA plays the performance device 14, the information providing device 10 may be used, for example, as follows. First, the user UA performs a first part of the piece of music in parallel with the playback of an accompaniment sound represented by music information $M_0$ (the music information M of the first embodiment described above), in the same way as in the first embodiment. The performance information QA, which represents a performance sound of the user UA, is transmitted to the information providing device 10 and is stored in the storage device 42 as music information $M_1$. Then, in the same way as the first embodiment, the user UA performs a second part of the piece of music in parallel with the playback of the accompaniment sound represented by the music information $M_0$ and the performance sound of the first part represented by the music information $M_1$. As a result of the above process being repeated, music information M is generated for each of multiple parts of the piece of music, with these pieces of music information M respectively representing performance sounds that synchronize together at an essentially constant performance speed. The control device 40 of the information providing device 10 synthesizes the performance sounds represented by the multiple pieces of the music information M, in order to generate music information M of an ensemble sound. As will be understood from the above explanation, it is possible to record (overdub) an ensemble sound in which respective performances of multiple parts by the user UA are multiplexed. It is also possible for the user UA to perform processing, such as deleting and editing, on each of the multiple pieces of music information M, each representing the performance of the user UA.

(4) In the first and second embodiments described above, the performance position T is identified by analyzing the performance information QA corresponding to the performance of the user UA; however, the performance position T may be identified by analyzing both the performance information QA of the user UA and the performance information QB of the user UB. For example, the performance position T may be identified by collating, with the score information S, a sound mixture of the performance sound represented by the performance information QA and the performance sound represented by the performance information QB. In a case where the users UA and UB perform mutually different parts of the piece of music, the performance analyzer 54 may identify the performance position T for each user U after identifying a part that is played by each user U among multiple parts indicated in the score information S.

(5) In the embodiments described above, a numerical value calculated through Expression (1) is employed as the adjustment amount $\alpha$, but a method of calculating the adjustment amount $\alpha$ corresponding to temporal variation in the performance speed V is not limited to the above described example. For example, the adjustment amount $\alpha$ may be calculated by adding a prescribed compensation value to the numerical value calculated through Expression (1). This modification enables the providing of music information M that corresponds to a time point that precedes a time point that corresponds to a performance position T of each user U, by a time length equivalent to a compensated adjustment amount $\alpha$, and is especially suitable for a case in which positions or content of performance are to be sequentially indicated to a user U, i.e., a case in which music information M must be indicated prior to the performance of a user U. For example, it is especially suitable for a case in which a pointer indicating a performance position is displayed on a score image, as described above. A fixed value set in advance, or a variable value that is in accordance with an indication from the user U may, for example, be set as the compensation value utilized in the calculation of the adjustment amount $\alpha$. Furthermore, a range of the music information M indicated to the user U may be freely selected. For example, in a configuration in which content to be performed by the user U is sequentially provided to the user U in the form of sampling data of the music information M, it is preferable to indicate, to the user U, music information M that covers a prescribed unit amount (e.g., a range covering a prescribed number of bars constituting the piece of music) from a time point corresponding to the adjustment amount $\alpha$.

(6) In each of the embodiments described above, the performance speeds V and/or the performance position T are analyzed with respect to the performance of the performance device 14 by the user UA, but performance speeds (singing speeds) V and/or performance position (singing position) T may also be identified for the singing of the user UA, for example. As will be understood from the above example, the "performance" in the present invention includes singing by a user, in addition to instrumental performance (performance in a narrow sense) using a performance device 14 or other relevant equipment.

(7) In the second embodiment, the speed analyzer 52 identifies performance speeds V of the user UA for a particular section in the piece of music. However, the speed analyzer 52 may also identify the performance speeds V across all sections of the piece of music, similarly to the first embodiment. The adjustment amount setter 56 identifies analyzed sections, and calculates, for each of the analyzed sections, a variation degree R among performance speeds V that fall in a corresponding analyzed section, from among the performance speeds V identified by the speed analyzer 52. Since the variation degrees R are not calculated for sections other than the analyzed sections, the performance speeds V in those sections other than the analyzed sections are not reflected in the variation degrees R (nor in the adjustment amounts $\alpha$). Substantially the same effects as those of the first embodiment are also obtained according to this modification. In addition, the adjustment amounts $\alpha$ are set in accordance with the performance speeds V in the analyzed sections of the piece of music, similarly to the second embodiment, and therefore, an advantage is obtained in that it is possible to set appropriate adjustment amounts $\alpha$ by identifying, as the analyzed sections, sections of the piece of music that are suitable for identifying the performance speeds V (e.g., a section in which the performance speed V is highly likely to be maintained essentially constant, or a section on which it is easy to identify the performance speeds V with good precision).

Programs according to the aforementioned embodiments may be provided, being stored in a computer-readable recording medium and installed in a computer. The recording medium includes a non-transitory recording medium, a preferable example of which is an optical storage medium, such as a CD-ROM (optical disc), and can also include a freely selected form of well-known storage media, such as a semiconductor storage medium and a magnetic storage medium. It is of note that the programs according to the present invention can be provided, being distributed via a communication network and installed in a computer.

The following aspects of the present invention may be derived from the different embodiments and modifications described in the foregoing.

An information providing method according to a first aspect of the present invention includes: sequentially identifying a performance speed at which a user performs a piece of music; identifying, in the piece of music, a performance position at which the user is performing the piece of music; setting an adjustment amount in accordance with a temporal variation in the identified performance speed; and providing the user with music information corresponding to a time point that is later, by the set adjustment amount, than a time point that corresponds to the performance position identified in the piece of music. In this configuration, a user is provided with music information that corresponds to a time point that is later, by the adjustment amount, than the time point that corresponds to a position that is being performed by the user in the piece of music. Accordingly, it is possible to reduce a delay in providing the music information, in comparison to a configuration in which a user is provided with music information corresponding to a time point that corresponds to a performance position by the user. Moreover, the adjustment amount is set to be variable in accordance with a temporal variation in the speed of performance by the user, and therefore, it is possible to guide the performance of the user such that, for example, the performance speed is maintained essentially constant.

Given that the performance speed tends to decrease over time when the adjustment amount is small and that the performance speed tends to increase over time when the adjustment amount is large, for example, a configuration is preferable in which the adjustment amount is set so as to decrease when the identified performance speed increases and increase when the performance speed decreases. According to this aspect of the invention, it is possible to guide the performance of the user such that the performance speed is maintained essentially constant.

According to a preferable embodiment of the present invention, the performance speed at which the user performs the piece of music is identified for a prescribed section in the piece of music. According to this embodiment, a processing load in identifying the performance speed is reduced in comparison to a configuration in which the performance speed is identified for all sections of the piece of music.

The performance position, in the piece of music, at which the user is performing the piece of music may be identified based on score information representing a score of the piece of music, and the prescribed section in the piece of music may be identified based on the score information. This configuration has an advantage in that, since the score information is used to identify not only the performance position but also the prescribed section, an amount of data retained can be reduced in comparison to a configuration in which information used to identify a prescribed section and information used to identify a performance position are retained as separate information.

A section in the piece of music other than a section on which an instruction is given to increase or decrease a performance speed, for example, may be identified as the prescribed section of the piece of music. In this embodiment, the adjustment amount is set in accordance with the performance speed in a section in which the performance speed is highly likely to be maintained essentially constant. Accordingly, it is possible to set an adjustment amount that is free of the impact of fluctuations in the performance speed, which fluctuations occur as a result of musical expressivity in performance of the user.

Furthermore, a section that has a prescribed length and includes notes of the number equal to or greater than a threshold in the piece of music may be identified as the prescribed section in the piece of music. In this embodiment, performance speeds are identified for a section on which it is relatively easy to identify the performance speed with good precision. Therefore, it is possible to set an adjustment amount that is based on performance speeds identified with high accuracy.

The information providing method according to a preferable embodiment of the present invention includes: identifying the performance speed sequentially by analyzing performance information received from a terminal device of the user via a communication network; identifying the performance position by analyzing the received performance information; and providing the user with the music information by transmitting the music information to the terminal device via the communication network. In this configuration, a delay occurs due to communication to and from the terminal device (a communication delay). Thus, a particularly advantageous effect is realized by the present invention in that any delay in providing music information is minimized.

According to a preferable embodiment of the present invention, the information providing method further includes calculating, from a time series consisting of a prescribed number of the performance speeds that are identified, a variation degree which is an indicator of a degree and a direction of the temporal variation in the performance speed, and the adjustment amount is set in accordance with the variation degree. The variation degree may, for example, be expressed as an average of gradients of the performance speeds, each of the gradients being determined based on two consecutive performance speeds in the time series consisting of the prescribed number of the performance speeds. Alternatively, the variation degree may also be expressed as a gradient of a regression line obtained, by linear regression, from the time series consisting of the prescribed number of the performance speeds. In this embodiment, the adjustment amount is set in accordance with the variation degree in the performance speed. Accordingly, frequent fluctuations in the adjustment amount can be reduced in comparison to a configuration in which an adjustment amount is set for each performance speed.

An information providing method according to a second aspect of the present invention includes: sequentially identifying a performance speed of performance of a user; identifying a beat point of the performance of the user; setting an adjustment amount in accordance with a temporal variation in the identified performance speed; and indicating, to the user, a beat point at a time point that is shifted with respect to the identified beat point by the set adjustment amount. According to the second aspect of the present invention, it is possible to guide the performance of the user such that the performance speed is, for example, maintained essentially constant.

The present invention may also be specified as an information providing device that executes the information providing methods set forth in the aforementioned aspects. The information providing device according to the present invention is either realized as dedicated electronic circuitry, or as a general processor, such as a central processing unit (CPU), the processor functioning in cooperation with a program.

DESCRIPTION OF REFERENCE SIGNS

100: communication system
10: information providing device
12 (12A, 12B): terminal device
14: performance device
18: communication network
30, 40: control device
32, 44: communication device
34: sound output device
42: storage device
50: analysis processor
52: speed analyzer
54: performance analyzer
56: adjustment amount setter
58: information provider

The invention claimed is:

1. An information providing method comprising the steps of:

sequentially identifying a performance speed at which a user performs a piece of music;

identifying, in the piece of music, a performance position at which the user is performing the piece of music;

setting an adjustment amount in accordance with a temporal variation in the identified performance speed;

providing the user with music information corresponding to a time point that is later, by the set adjustment amount, than a time point that corresponds to the performance position identified in the piece of music;

calculating, from a time series consisting of a prescribed number of performance speeds that are identified, a variation degree, which is an indicator of a degree and a direction of the temporal variation in the performance speed, wherein the setting step sets the adjustment amount in accordance with the variation degree.

2. The information providing method according to claim 1, wherein the setting step sets the adjustment amount to decrease when the identified performance speed increases and to increase when the identified performance speed decreases.

3. The information providing method according to claim 1, wherein the speed identifying step sequentially identifies the performance speed with regard to a prescribed section in the piece of music.

4. The information providing method according to claim 3, wherein:

the position identifying step identifies the performance position in the piece of music at which the user is performing the piece of music, based on score information representing a score of the piece of music, and the prescribed section in the piece of music is identified based on the score information.

5. The information providing method according to claim 4, wherein the prescribed section is a section in the piece of music other than a section on which an instruction is given to increase or decrease the performance speed.

6. The information providing method according to claim 4, wherein the prescribed section is a section that has a prescribed length and includes notes of a number equal to or greater than a threshold, in the piece of music.

7. The information providing method according to claim 1, wherein:

the speed identifying step sequentially identifies the performance speed by analyzing performance information received from a terminal device of the user via a communication network, the position identifying step identifies the performance position by analyzing the received performance information, and the information providing step transmits the music information to the terminal device via the communication network.

8. The information providing method according to claim 1, wherein the variation degree is expressed as an average of gradients of the performance speeds, each of the gradients being determined based on two consecutive performance speeds in the time series consisting of the prescribed number of the performance speeds.

9. The information providing method according to claim 1, wherein the variation degree is expressed as a gradient of a regression line obtained from the time series consisting of the prescribed number of the performance speeds by linear regression.

10. An information providing device comprising:

a controller having a processor configured to implement instructions stored in a memory or an electronic circuitry that executes a plurality of tasks, including:

a speed identifying task that sequentially identifies a performance speed at which a user performs a piece of music;

a position identifying task that identifies, in the piece of music, a performance position at which the user is performing the piece of music;

a setting task that sets an adjustment amount in accordance with a temporal variation in the identified performance speed;

an information providing task that provides the user with music information corresponding to a time point that is later, by the set adjustment amount, than a time point that corresponds to the identified performance position in the piece of music; and a variation degree calculating task that calculates, from a time series consisting of a prescribed number of performance speeds that are identified, a variation degree, which is an indicator of a degree and a direction of the temporal variation in the performance speed, wherein the setting task sets the adjustment amount in accordance with the variation degree.

11. The information providing device according to claim 10, wherein the setting task sets the adjustment amount to decrease when the identified performance speed increases, and to increase when the identified performance speed decreases.

12. The information providing device according to claim 10, wherein the speed identifying task sequentially identifies the performance speed for a prescribed section in the piece of music.

13. The information providing device according to claim 12, wherein:

the position identifying task identifies the performance position in the piece of music at which the user is performing the piece of music, based on score information representing a score of the piece of music, and the prescribed section in the piece of music is identified based on the score information.

14. The information providing device according to claim 13, wherein the prescribed section is a section, in the piece of music, other than a section on which an instruction is given to increase or decrease a performance speed.

15. The information providing device according to claim 13, wherein the prescribed section is a section that has a prescribed length and includes notes of a number equal to or greater than a threshold, in the piece of music.

16. The information providing device according to claim 10, further comprising:

a network communication device that communicates with a terminal device of the user via a communication network, wherein the speed identifying task sequentially identifies the performance speed by analyzing performance information received by the network communication device from the terminal device of the user, the position identifying task identifies the performance position by analyzing the performance information received by the network communication device, and the information providing task transmits the music information to the terminal device via the network communication device.

17. An information providing method comprising the steps of:

sequentially identifying a performance speed at which a user performs a piece of music;

identifying, in the piece of music, a beat point at which the user is performing the piece of music;

setting an adjustment amount in accordance with a temporal variation in the identified performance speed;

indicating, to the user, a beat point in the piece of music at a time point that is shifted with respect to the identified beat point by the set adjustment amount; and calculating, from a time series consisting of a prescribed number of performance speeds that are identified, a variation degree, which is an indicator of a degree and a direction of the temporal variation in the performance speed, wherein the setting step sets the adjustment amount in accordance with the variation degree.

* * * * *